US005449969A

United States Patent [19]

Washburn

[11] Patent Number: 5,449,969

[45] Date of Patent: Sep. 12, 1995

[54] CATHODE RAY TUBE DEFLECTOR YOKE ASSEMBLY

[76] Inventor: Clayton A. Washburn, 24 Andrea La., Thornwood, N.Y. 10594

[21] Appl. No.: 110,706

[22] Filed: Aug. 23, 1993

[51] Int. Cl.[6] ..... H01J 29/70

[52] U.S. Cl. ..... 313/440; 313/421

[58] Field of Search ..... 313/440, 421; 315/210–213, 296–297; 348/749, 805, 745; 335/210–213

[56] References Cited

U.S. PATENT DOCUMENTS 3,622,927 11/1971 Washburn ..... 335/210

4,961,021 10/1990 Oguro et al. ..... 313/440

*Primary Examiner*—Stephen Brinich

*Attorney, Agent, or Firm*—Nolte, Nolte and Hunter

[57] ABSTRACT

A deflection yoke assembly with an annular magnetic core to energize a magnetic deflection field within a CRT and an annular array of pole pieces to define the length and shape of the magnetic deflection field mounted within and concentric with the annular core.

21 Claims, 4 Drawing Sheets

CATHODE RAY TUBE DEFLECTOR YOKE ASSEMBLY

FIELD OF THE INVENTION

This invention is concerned with improvements in magnetic deflection yokes used for electron beam deflection in cathode ray tubes.

The invention provides an annular pattern of pole pieces comprised of a high permeability magnetic material which defines the internal deflection field of the cathode ray tube. It provides a precise and uniformly graded field. It shields out spurious field components of the conventional yoke and it provides substantially higher deflection yoke efficiency. Its confined fields also reduce electromagnetic radiation external to the CRT assembly.

BACKGROUND OF THE INVENTION

This invention is concerned with improvements in magnetic deflection yokes used for electron beam deflection in cathode ray tubes generally of the display producing variety requiring relatively large angles of deflection and wherein the deflection field is short compared to the beam throw distance to the CRT faceplate. It is not applicable to those types commonly known as immersion field systems primarily used in image pickup (camera) devices.

The prior art has gradually evolved in response to requirements for larger deflection angles and high beam spot performance from a primarily cylindrical magnetic core to one using an annular magnetic core having a substantial front flare in which there is an increase in internal core diameter as a function of core length. The result is a more uniformly graded deflection field in the direction of the electron beam or z axis. The above evolution applies to use of two principal construction techniques. One uses solid smooth surfaced flared annular cores in conjunction with distributed (typically form wound) coil sets and/or toroidal windings. The other uses slotted flared annular stator cores. Either method of construction is applicable with the improvements to be described herein.

In a deflection yoke of either of the above types there is substantial magnetic field outside of the CRT, (hence out of the required deflection field region) due to both the diameter of the yoke and to its end turn and other external field distributions. These fields reduce efficiency of the yoke and, unless carefully controlled, they can introduce distortions of the electron beam. The various parts and windings must be controlled to a high degree of precision in order to provide a high resolution output display of the associated CRT.

Over many years of deflection yoke development, there has been no significant improvement in its efficiency and, in fact, the shift to flared core designs loses efficiency. It is the purpose of this invention to provide a substantial increase in deflection yoke efficiency. It is a further purpose to improve performance at the same time making construction of the main yoke assembly less critical.

SUMMARY OF THE INVENTION

The invention provides an annular (preferably circular) assembly of magnetic pole pieces which defines the length and shape of the CRT internal magnetic deflection field. This field is energized by the magnetomotive force (MMF) of an external magnetic deflection yoke.

Its annular core need not be circular, only that it apply correct MMF produced by the windings of the coils and in conjunction with the yoke core. It is preferable that the pole piece assembly be located on the inside of the CRT's flared funnel. However, at some reduction in efficiency, it may be on the outside of the funnel. Use of the pole piece assembly allows the deflection yoke core and its windings to be substantially shorter (in the direction of the z axis) than those on a conventional yoke of equivalent internal field. The pole piece assembly also shields the coil end turns. End turns, therefore, do not have to be extended or arced away from the main field. They may be shortened and positioned such as to minimize external fields. This also simplifies shielding of external fields. The result is a yoke of maximum deflection efficiency with reduced inductance and resistance and without external or extraneous internal, such as end turn, field interference. Coil winding and core accuracy is less critical.

These benefits come at a cost. The method is achievable by use of high permeability $\mu$ and high saturation magnetic materials. Because of required yoke field densities, pole pieces made of such materials must be of small cross sectional area hence, limited width and thickness, so that their application as to be described becomes practical. A requirement for substantial material area would rapidly remove the advantages to be gained due to the material's own space and fringe field losses. However, the requirement for low cross-section results in high residual magnetism. Accordingly, the materials used should be of very low reluctance yet have a high saturation value. A number of materials have been developed meeting these requirements. Availability of some superior magnetic alloys have been reported in research literature, but they are not readily available. Their performance can greatly expand the range of application. The class of nickel-iron alloys, related to the generic class term mu metal, serves very well within its maximum saturation level which ranges from 4 to 10 KG auss. However, one widely practical method, as example, employs sheet stock of very high purity iron (Fe) which, after fabrication and preforming, is vacuum annealed in a time/temperature control sequence to develop its maximum performance which is high, both $\mu$ and saturation level. Materials thickness required typically ranges from 0.015" to 0.060". The annealed pole pieces are precisely placed and, in a preferred embodiment of the invention, are bonded to the inside of the neck of the CRT funnel. The CRT vacuum enclosure protects the assembly from deterioration.

The pole pieces may also be arrayed in a harness which may be sized for disposition about the internal or external surface of the neck of the CRT and concentric with the core of the yoke.

The best of current, generally available materials is not adequate for those random beam positioning applications which require high precision—a general number being in the range, as example, less than 0.05%. However, applications using preset sequential scan arrangements, for example, TV-type displays—even though required to be of high precision—are not sensitive to residual magnetism errors because they are of fixed value in one direction and, if necessary, may be corrected by other means. Accordingly, applications of this type are the main field of use of the invention.

DETAILED DESCRIPTION OF THE DRAWINGS

Figure 1:
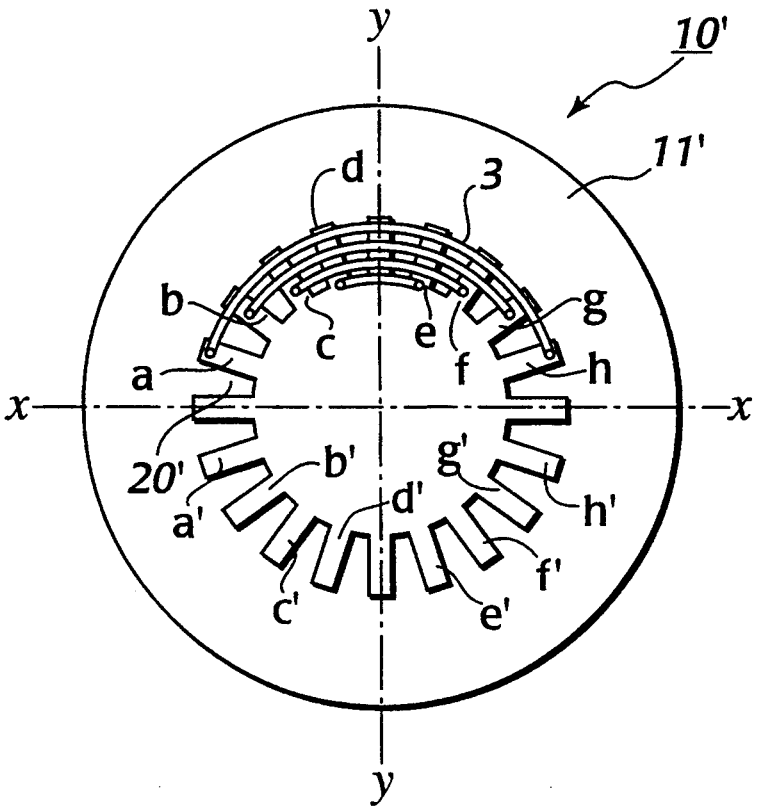
FIG. 1 is an end view of the back end of a unique magnetic deflection yoke winding assembly diagrammatically illustrating one of the yoke's four coil windings in relation to its core pole pieces.
Figure 2:
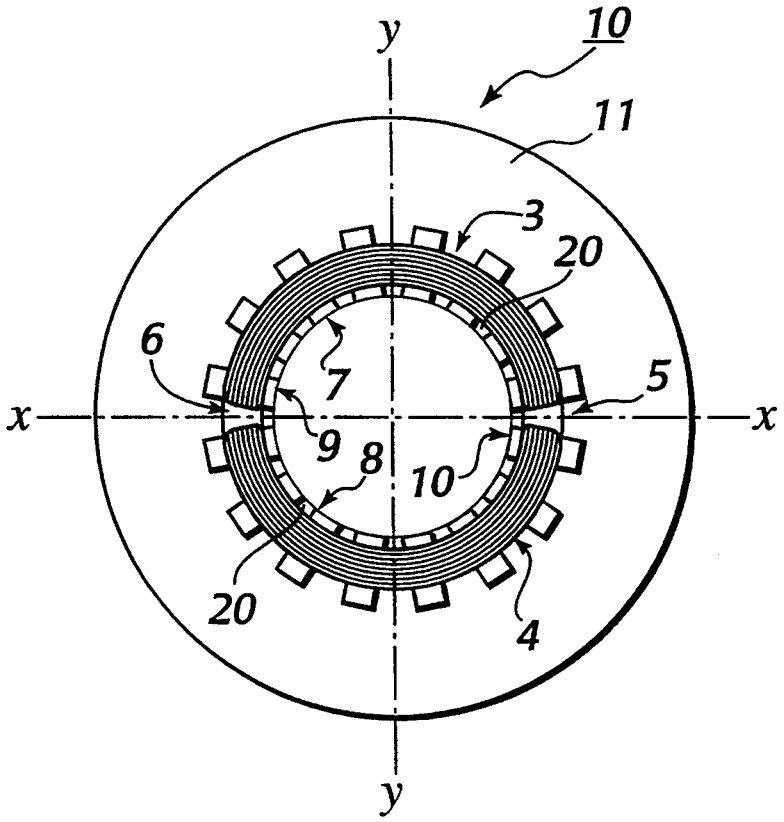
FIG. 2 is a view of the back end of the magnetic deflection yoke of FIG. 3 showing a conventional winding.
Figure 3:
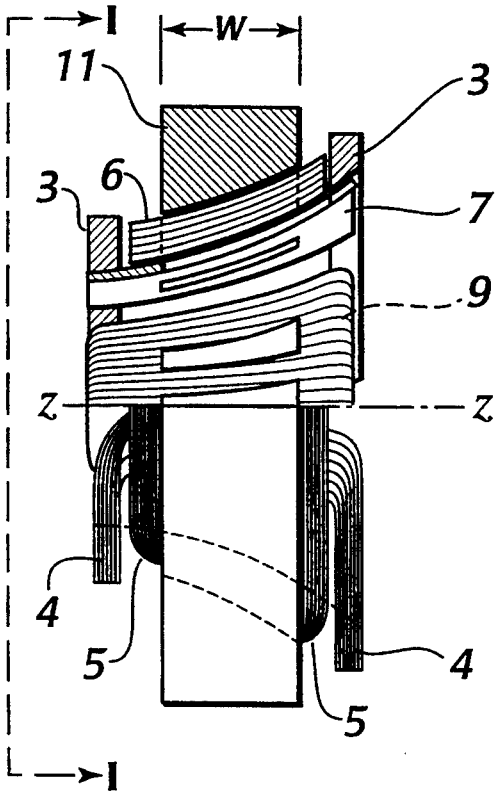
FIG. 3 is a side elevational view of a magnetic deflection yoke partially broken away.

FIGS. 1–3 show magnetic cores 11, 11' and coil winding variation of deflection yokes 10, 10'. Such cores may be either cylindrical or flared from rear to front as in the core of the figures. They may have a smooth internal surface (not shown) in which case they are used with coil winding (also smooth), but of tapered z axis shape in conformance with the well-known cosine distribution or variations thereof. Such coils having end turns are commonly referred to as saddle coils; when wound back around the outside of the core as toroidal coils. Or the core may be slotted, as shown, with internally directed teeth 20 in FIGS. 2–6; 20' in FIG. 1. Such cores are commonly referred to as stator cores. Early versions were made from punched lamination stacks. Next came corresponding cylindrical cores made of ferrite and finally the advantages of flared structure were realized by using molded flared ferrite cores in providing high resolution performance at large angles of beam deflection.

FIG. 1 provides a diagrammatic illustration of the winding of one of the stator yoke's coil windings on a unique core/coil configuration. This core has an odd number of poles per quadrant and is arranged with an inactive slot at each axis in contrast with the conventional even pole core of FIGS. 2–6. The winding arrangement and number of coils is otherwise the same as conventionally shown in FIGS. 2 and 3. Turns of wire are wound through the slots starting, for example, at slot a and returning through slot h. The winding progresses successively to slots b–g, c–f and finishing at d–e wherein the turns of each group is distributed in accordance with the cosine of pole angle or, more precisely, with minor correction due to the pole piece discontinuity error.

FIGS. 2 and 3 show the windings of a complete deflection yoke. As contemplated for use in a preferred embodiment of the invention, both FIG. 1 and FIG. 2 have 45° symmetry (see U.S. Pat. No. 3,622,927). The yoke of FIGS. 2 and 3 has sixteen slots forming sixteen teeth or stator poles.

Each deflection axis requires coils which are the mirror image of coil 3. Thus, x deflection is provided by coils 3 and 4 in slots a–h, b–g and a'–h', b '–g, respectively, and coils 7 and 8 in slots c–f, d–e and c'–f', d'–e', respectively. The y axis coils are referenced 5–6 and 9–10 positioned at 90° to x coils. The assembly of FIG. 3 corresponds to prior art with the exception that the yoke field is unusually short corresponding to a short core width w. In the practice of this invention, any of the miscellaneous variations of yoke winding and assembly methods are applicable. The winding of FIGS. 1–3 is believed not to be prior art. It shows how to achieve a stator winding having 45° symmetry as well as some improvement in performance and efficiency.

Figure 4:
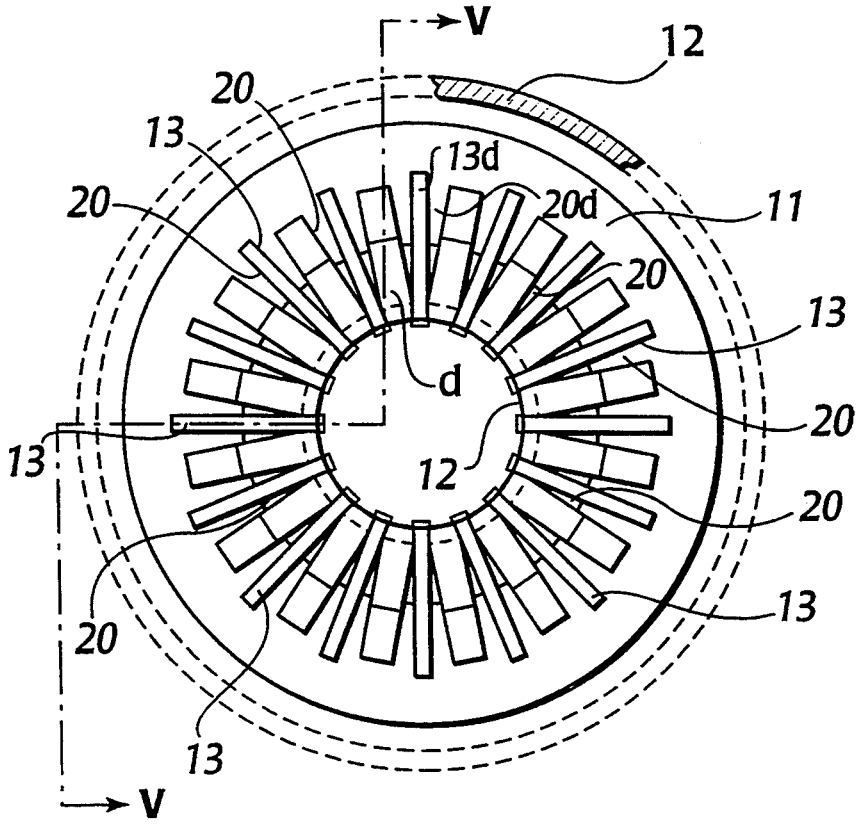
FIG. 4 is a front end view taken along the line 4—4 of FIG. 5 through the glass funnel of a CRT and showing the annular assembly of core pieces in relation to the poles of the flared stator core of FIGS. 2–3.
Figure 5:
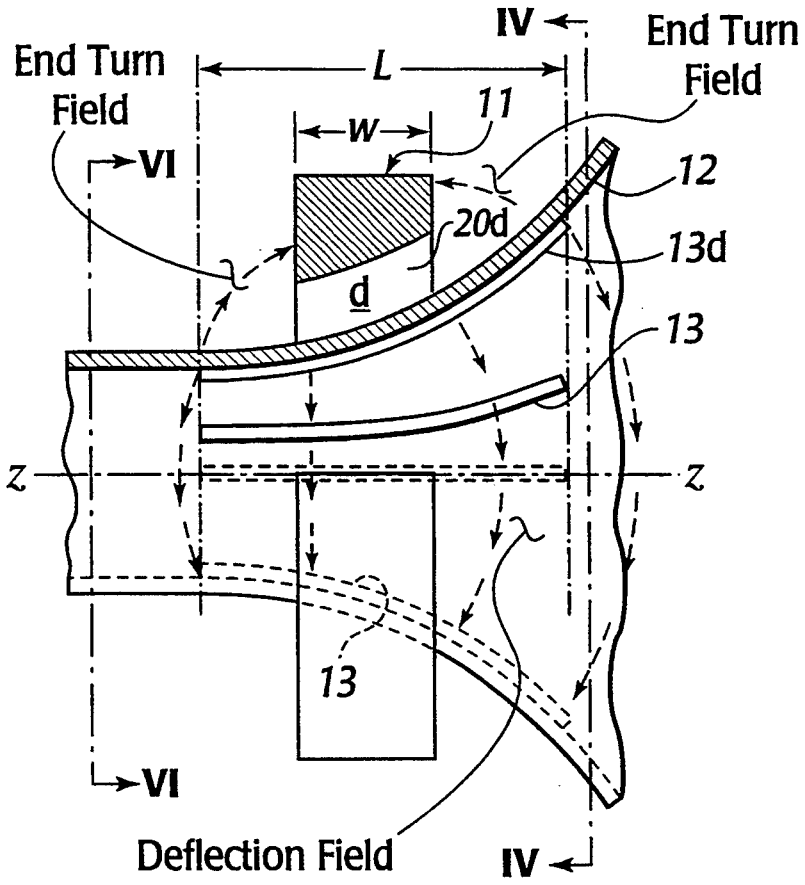
FIG. 5 is a partial longitudinal sectional view of the yoke assembly taken along the line 5—5 of FIG. 4 and schematically showing magnetic deflection field distribution along the z axis.
Figure 6:
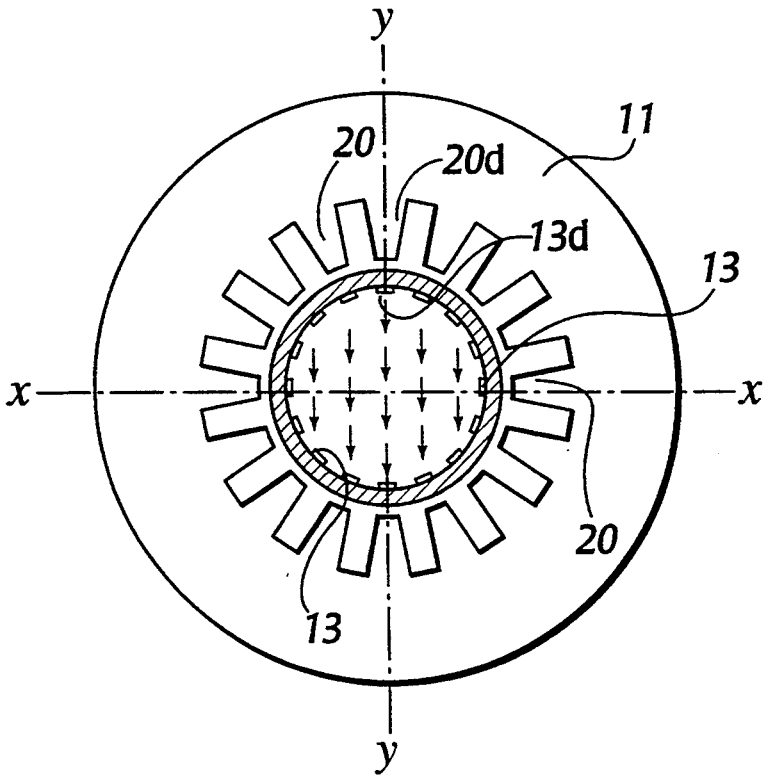
FIG. 6 is a rear end view taken along the line 6—6 of FIG. 5 and schematically showing uniform magnetic deflection field distribution for the x axis.

In order that the magnetic core structure be clearly revealed, the coil structures have been deleted from FIGS. 4–6. Their inclusion would obscure core details and, as noted, many winding types could be used.

FIGS. 4–6 show the external core 11 in position about the neck of a CRT 12. Internal to the core is a corresponding annular assembly of sixteen pole pieces 13, constructed of high permeable material, as above discussed, having x, y axis quadrant symmetry and, in the example using a stator core 11, one such pole piece is located directly under each corresponding pole 20 of the stator core. Note pole piece **13*d* underlying "tooth" or stator pole 20*d* adjacent slot d. The pole piece 13** may be bonded to the surface of the CRT in any known manner or may be assembled in a non-magnetic harness, discussed below, fitted within the CRT neck. The harness is required to be from a well known choice of vacuum and temperature compatable materials.

The length L of the pole pieces is substantially longer than the width W of the core 11 and this length determines the effective length of the yoke's deflection field as schematically shown by the arrows in FIGS. 5 and 6. There is an optimum ratio for efficiency. Too long pole pieces cause external end fields which do not deflect. At the same time, the pole pieces 13 confine this field to the volume inside the annulus formed by the annular assembly of pole pieces. This field is of substantially smaller volume and therefor energy than that of a conventional yoke.

Referring to the arrows of FIG. 6, they show typical magnetic field distribution for x axis deflection. With correct turns distribution, the flux across the x axis is uniform. The z axis lines (FIG. 5) bulge forward and rearward in accordance with pole curvature and it is known that optimum curvature can provide an anastigmatic yoke provided there is circular symmetry and no interference from end turn fields. In the design disclosed, the pole pieces shield such end turn fields from entering the deflection region.

Referring now to the internal field as shown by FIGS. 5 and 6, the equations of electron ballistics are well known for determining the field flux density $\beta$ required to produce a specified angular deflection at a specified electron beam velocity, and this field strength determines the cross-sectional area requirements of the internal pole pieces 13 configuration. It will first be observed that if the width of pole pieces (**13*d* as example) is made too wide compared to the distance between pole centers of core 11, a large flux will be shunted around and through the circumference of poles. Accordingly, pole width must be balanced against other loses. It will next be observed that all the flux $\beta$ emanating from pole pieces 13 behind and in front of core 11 must route through the cross-sectional area of the pole pieces at the junctures of 11 and 13. The poles 13** must, therefore, have a width and thickness great enough to carry the required flux without saturating. The pole lengths forward and aft should be adjusted so they carry the same flux. This typically results in longer forward extension of about 50%.

Figure 7:
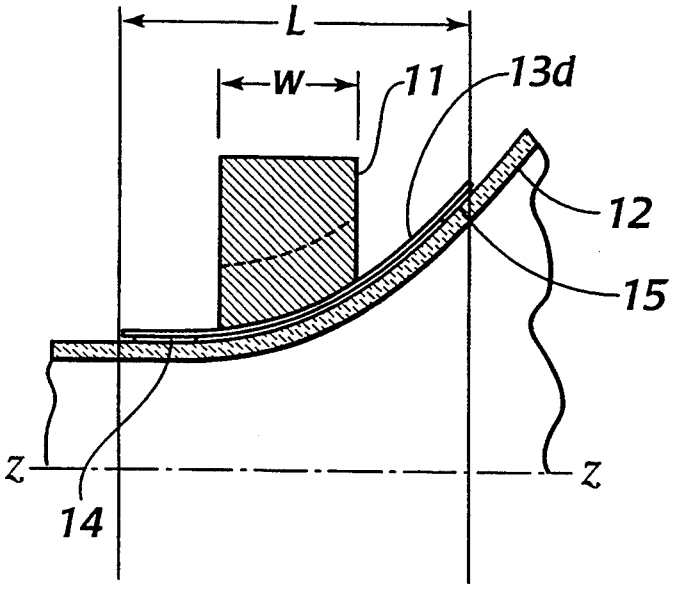
FIG. 7 is a sectional slice through the axis of a yoke and CRT in which the pole pices are assembled in a harness.

Alternatively, the pole piece assembly may be located just outside the neck of the CRT funnel 12 as shown in the sectional slice of FIG. 7 in which the pole pieces 13' are assembled in a harness, comprising back and front non-magnetic collars 14–15 which fits the outer surface of the neck of the CRT. In this case, the pole ends may be precision jiged and bonded to a thin rear cylindrical collar 14 and a similar thin front conical collar 15 of, for example, mylar film before final bonding to the poles of core element 11. Alternatively, and particularly suited to preformed coils with smooth core design, the harness 14–15 may be a thin preformed epoxy funnel to match the CRT neck portion 12. In these arrangements, the outer yoke assembly may be rotatably mounted to provide optimum vernier adjustment to pole assembly 13 before final bonding.

A prototype design will illustrate typical design. The unit has external (CRT) pole pieces for use with a 90°, 20 KV CRT having a 29 mm flared neck. Core width W is ¾", pole length (Z axis) is 1 and ¾" giving ratio . Pole width is 0.11" and the spacing between the poles is also 0.11" (a 50% ratio at the back end) and thickness is 0.032". Material is mu metal (annealed in inert atmosphere) which provides a marginally high enough saturation level to meet the deflection requirement. Compared to conventional design, the unit's resistance loss is reduced to 0.4 of a conventional yoke, whereas inductive energy is only reduced 10% instead of 30 to 40% due to external poles, not optimum design ratios and saturation loss of the poles. It may be seen that to obtain a high pole to core ratio and to achieve the high efficiency capability of the design requires high performance magnetic pole pieces as has been described.

According to the application and material used, the range of pole thickness is from 0.015" to 0.060".

What I claim is:

1. In a cathode ray tube deflection yoke assembly, the combination of:

an annular magnetic core comprising means for energizing a magnetic deflection field within a CRT and having a predetermined fore and aft thickness extending annularly about a z axis; and an annular array of pole pieces comprising means for defining the length and shape of said magnetic deflection field, each of said pole pieces consisting of a strip of high permeability magnetic material having a predetermined length greater than the thickness of said magnetic core; and means for mounting said annular array spaced from and wholly within and concentric with said annular core.

2. The deflection yoke assembly of claim 1 in further combination with a CRT having a neck, wherein said annular core is mounted about said neck of said CRT; and said annular array of pole pieces is mounted concentrically with said CRT neck.

3. The deflection yoke assembly of claim 2 wherein said magnetic core is flared from aft to fore.

4. The deflection yoke assembly of claim 1 wherein each of said plurality of pole pieces is formed of a high magnetic material purity iron having high permeability and a high saturation level, said material including high purity iron and iron-nickel alloys optimally annealed in an inert oven.

5. The deflection yoke assembly of claim 1 wherein each of said plurality of pole pieces has a thickness of from 0.015" to 0.060".

6. The deflection yoke assembly of claim 1 wherein the ratio of the length of said pole pieces to the width of said annular core is in the range 1.5 to 4.

7. The deflection yoke assembly of claim 1 in further combination with a CRT having a neck and a funnel extending from said neck, wherein said annular core is mounted about the juncture of said neck and funnel of said CRT; and said annular array of pole pieces is mounted concentrically with said CRT neck.

8. In a cathode ray tube deflection yoke assembly, the combination of:

an annular magnetic core comprising means for energizing a magnetic field within a CRT and having a predetermined fore and aft thickness extending annularly about a z axis;

an annular array of pole pieces comprising means for defining the length and shape of said magnetic deflection field, each of said pole pieces consisting of a strip of high permeability magnetic material having a predetermined length greater than the thickness of said magnetic core;

means for mounting said annular array within and concentric with said annular core;

a CRT having a neck;

said annular core being mounted about said neck of said CRT;

said annular array of pole pieces being mounted concentrically with said CRT neck about the inner surface of said CRT neck.

9. In a cathode ray tube deflection yoke assembly, the combination of:

an annular magnetic core comprising means for energizing a magnetic field within a CRT and having a predetermined fore and aft thickness extending annularly about a z axis;

an annular array of pole pieces comprising means for defining the length and shape of said magnetic deflection field, each of said pole pieces consisting of a strip of high permeability magnetic material having a predetermined length greater than the thickness of said magnetic core;

means for mounting said annular array within and concentric with said annular core;

a CRT having a neck;

said annular core being mounted about said neck of said CRT;

said annular array of pole pieces being mounted concentrically with said CRT neck;

said means mounting said annular array of pole pieces including an annular harness disposed about the outer surface of said CRT neck;

said pole pieces being secured in circumferentially spaced relation in said harness.

10. In a cathode ray tube deflection yoke assembly, the combination of:

an annular magnetic core comprising means for energizing a magnetic field within a CRT and having a predetermined fore and aft thickness extending annularly about a z axis;

an annular array of pole pieces comprising means for defining the length and shape of said magnetic deflection field, each of said pole pieces consisting of a strip of high permeability magnetic material having a predetermined length greater than the thickness of said magnetic core;

means for mounting said annular array within and concentric with said annular core;

a CRT having a neck;

said annular core being mounted about said neck of said CRT;

said annular array of pole pieces being mounted concentrically with said CRT neck;

said magnetic core being flared from aft to fore;

said magnetic core being a stator core having slots defining stator poles extending in radial planes through said z axis;

each said pole piece of said annular array being aligned with said z axis and with a respective one of said stator poles of said annular magnetic core.

11. The deflection yoke assembly of claim 10 wherein each of said plurality of pole pieces is formed of a high magnetic material purity iron having high permeability and a high saturation level, said material including high purity iron and iron-nickel alloys optimally annealed in an inert oven.

12. The deflection yoke assembly of claim 10 wherein each of said plurality of pole pieces has a thickness of from 0.015" to 0.060".

13. The deflection yoke assembly of claim 10 wherein the ratio of the length of said pole pieces to the width of said annular core is in the range 1.5 to 4.

14. The deflection yoke of claim 10 having an odd number of stator poles per quadrant defined by x and y axes, windings about said stator pole pieces and in said slots except in slots at each axis, said slots being inactive.

15. The deflection yoke of claim 14 having 12 stator poles and an inactive slot at each axis.

16. The deflection yoke of claim 14 having 20 stator poles and an inactive slot at each axis.

17. In a cathode ray tube deflection yoke assembly, the combination of:

an annular magnetic core constructed and arranged to surround the juncture of the neck and funnel of a cathode ray tube, said annular core having a predetermined fore and aft thickness extending annularly about a z axis;

means associated with said magnetic core for energizing a magnetic deflection field within said annular magnetic core;

an annular array of pole pieces comprising means for defining the length and directional shape of said magnetic deflection field along said z axis within the neck and funnel juncture of the cathode ray tube, each of said pole pieces consisting of a strip of high permeability magnetic material having a predetermined length greater than said fore and aft thickness of said magnetic core; and means for mounting said annular array spaced from and wholly within said means for energizing a magnetic field and concentric with said annular core.

18. The deflection yoke assembly of claim 17 wherein said magnetic core is flared aft to fore.

19. The deflection yoke assembly of claim 17 wherein each of aid plurality of pole pieces is formed of a high magnetic material purity iron having high permeability and a high saturation level, said material including high purity iron and iron-nickel alloys optimally annealed in an inert oven.

20. The deflection yoke assembly of claim 17 wherein each of said plurality of pole pieces has a thickness of from 0.015" to

21. The deflection yoke assembly of claim 17 wherein the ratio of the length of said pole pieces to the width of said annular core is in the range 1.5 to 4.

* * * * *

UNITED STATES PATENT AND TRADEMARK OFFICE

CERTIFICATE OF CORRECTION

PATENT NO. : 5,449,969

DATED : September 12, 1995

INVENTOR(S) : CLAYTON A. WASHBURN

EST AVAILABLE COPY

It is certified that error appears in the above-identified patent and that said Letters Patent is hereby corrected as shown below:

In Column 8, of the printed patent at line 33, after "to" as there printed should be --.060".--.

Signed and Sealed this

Twenty-first Day of November, 1995

Bruce Lehman

*Attest:*

BRUCE LEHMAN

*Attesting Officer*

*Commissioner of Patents and Trademarks*